US005480088A

United States Patent [19]

Braun et al.

[11] Patent Number: 5,480,088

[45] Date of Patent: Jan. 2, 1996

[54] OVERDRIVE SIGNALLING STRUCTURE FOR FASTENER DRIVING TOOL

[75] Inventors: Phillip M. Braun, Exeter, R.I.; John J. Harrison, Pawcatuck, Conn.; Arthur E. Perra, Hope Valley, R.I.; Patrick J. Scanlon, East Greenwich, R.I.; David J. Simonelli, Coventry, R.I.

[73] Assignee: Stanley-Bostitch, Inc., East Greenwich, R.I.

[21] Appl. No.: 291,706

[22] Filed: Aug. 16, 1994

[51] Int. Cl.[6] ..... B25C 1/04

[52] U.S. Cl. ..... 227/130; 227/5; 227/156; 173/20

[58] Field of Search ..... 173/20, 21; 227/130, 227/156, 5, 10

[56] References Cited

U.S. PATENT DOCUMENTS 4,610,381 9/1986 Kramer et al. .

*Primary Examiner*—Rinaldi I. Rada
*Assistant Examiner*—Jay A. Stelacone
*Attorney, Agent, or Firm*—Cushman, Darby & Cushman

[57] ABSTRACT

A fastener driving tool is provided including a portable housing defining a fastener drive track, a fastener driving element carried by the housing for movement within the drive track through successive cycles of operation, each of which includes a fastener driving stroke and a return stoke, and a drive piston operatively connected with the fastener driving element for movement therewith. The tool also has a magazine assembly carried by the housing for receiving a supply of fasteners and feeding successive fasteners into the drive track in a position to be driven into a work piece during successive fastener driving strokes of the fastener driving element, an actuating structure carried by the housing and being constructed and arranged to move from a normal, inoperative position into an operative position to initiate the movement of the drive piston and the fastener driving element through a fastener driving stroke, and an overdrive signaling structure carried by the housing. The overdrive signalling structure includes an impulse responsive member constructed an arranged (1) to remain in a first position when the fastener driving tool is being operated at an acceptable power required to drive a fastener into the work piece and (2) to move from the first position thereof to a second position in response to an excessive impulse force resulting from a fastener driving stroke of the tool, thereby signaling the tool operator that the tool is being operated at a power in excess of the power requirements to drive a fastener into the work piece.

7 Claims, 2 Drawing Sheets

OVERDRIVE SIGNALLING STRUCTURE FOR FASTENER DRIVING TOOL

BACKGROUND OF THE INVENTION

This invention relates to fastener driving tools and, more particularly, to fastener driving tools including an indicator for signalling the operator that the operator may be missing the substructure intended to be fastened or that the tool is being supplied by too great air pressure and is overdriving.

The type of fastener driving tool hereto contemplated typically includes a fastener driving element or driver which is mounted within a drive track within which successive fasteners are fed. The driver is mounted for movement through repetitive cycles, each of which includes a drive stroke during which the fastener is moved out of the drive track into the work piece and a return stroke. The fastener driving element is fixedly connected with a piston which is mounted within a cylinder for movement through a drive stroke and a return stroke with the fastener driving element. The piston is driven preferably by compressed air applied to an operative surface of the piston. The fastener driven by the driving element absorbs most of the tool energy. The remainder of the tool energy is absorbed by the tool, primarily through an annular bumper of resilient material mounted in a position to be engaged by the piston and defining the end the drive stoke thereof. Substantially different fastener driving forces are required to drive a fastener due to variances in wood type, moisture or knots in the substructure to be nailed. For example, where soft wood underlies a fastener position, only a light driving force is required to fully seat the fastener. When harder wood or knots underlie a fastener position, much greater forces are required for similar results. In addition, if a stud or joist substructure is missed, the tool may be operated with such a force so as to cause overdriving. If a tool is operated continuously in an overdriving manner, the life of the tool is shortened. Further, when the substructure is missed, fasteners are wasted and do not perform their function of coupling to the substructure, which increases costs and reduces productivity.

SUMMARY OF THE INVENTION

An object of the present invention is to provide a fastener driving tool which includes an indicator that signals the operator that the power of tool, as adjusted, is in excess of the requirements to drive the fastener. The indicator signals the operator that the operator may be missing the substructure intended to be fastened, or that the tool has too great air pressure and is overdriving.

In accordance with the principles of the present invention, this objective is obtained by providing a fastener driving tool including a portable housing defining a fastener drive track, a fastener driving element carried by the housing for movement within the drive track through successive cycles of operation, each of which includes a fastener driving stroke and a return stoke, a drive piston operatively connected with the fastener driving element for movement therewith, a magazine assembly carried by the housing for receiving a supply of fasteners and feeding successive fasteners into the drive track in a position to be driven into a work piece during successive fastener driving strokes of the fastener driving element, actuating structure carried by the housing and being constructed and arranged to move from a normal, inoperative position into an operative position to initiate the movement of the drive piston and the fastener driving element through a fastener driving stroke, and overdrive signaling structure carried by the housing and including an impulse responsive member constructed and arranged (1) to remain in a first position when the fastener driving tool is being operated at an acceptable power required to drive a fastener into the work piece and (2) to move from the first position thereof to a second position in response to an excessive impulse force resulting from a fastener driving stroke of the tool, thereby signaling the tool operator that the tool is being operated at a power in excess of the power requirements to drive a fastener into the work piece.

Another object of the present invention is the provision of a device of the type described, which is simple in construction, effective in operation and economical to manufacture and maintain.

These and other objects of the present invention will become more apparent during the course of the following detailed description and the appended claims.

The invention may be best understood with reference to the accompanying drawings wherein illustrative embodiment is shown.

DETAILED DESCRIPTION OF THE INVENTION

Figure 1:
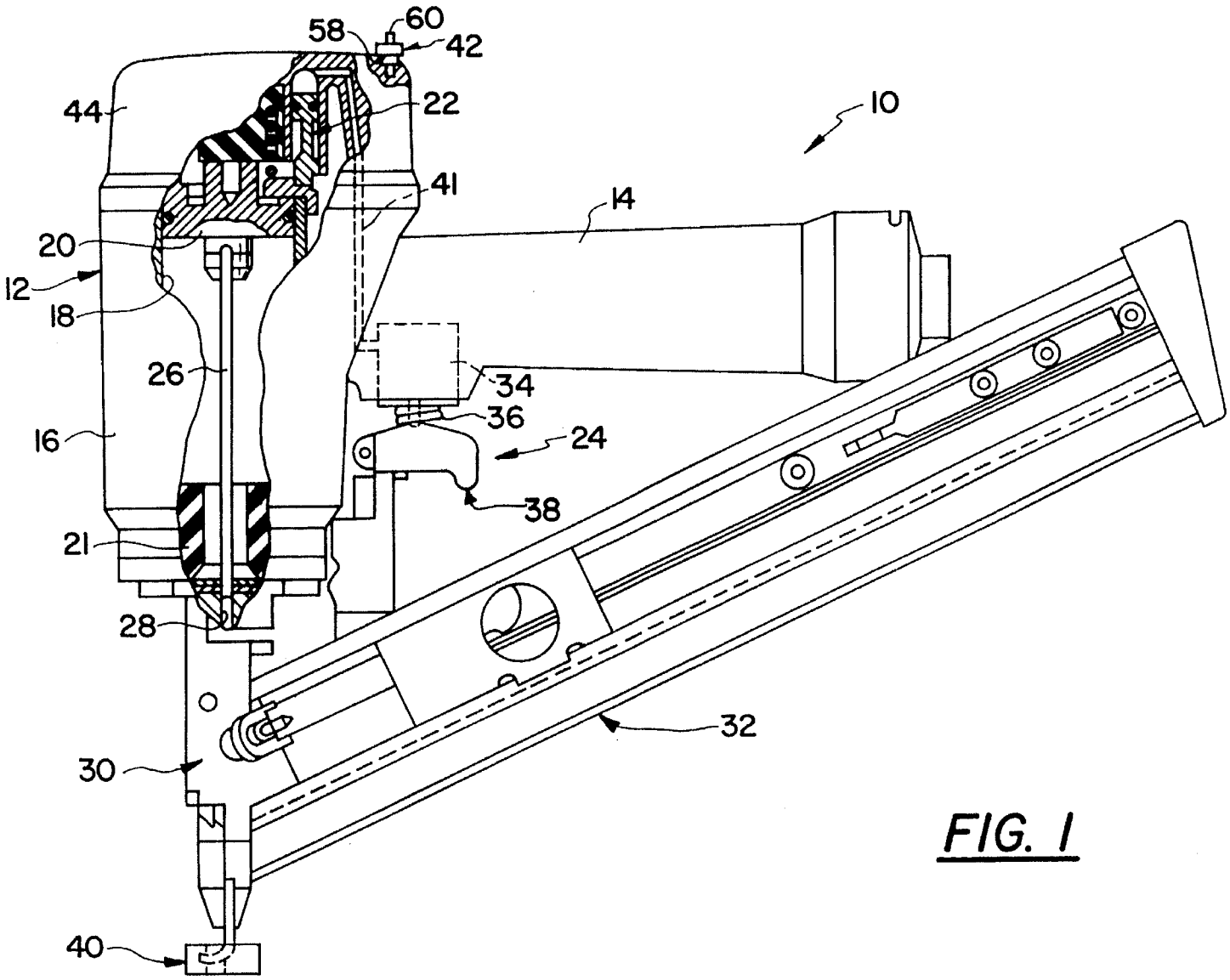
FIG. 1 is a side elevational view, with parts in section, of a pneumatically operated fastener driving tool including overdrive signalling structure provided in accordance with the principles of the present invention.

Referring more particularly to the Figures, a fastener driving tool, generally indicated at 10, is shown which embodies the principles of the present invention. The power operated tool illustrated is of the fluid pressure operated type and includes the usual portable housing, generally indicated at 12, which includes a handle grip portion 14 of hollow configuration which constitutes a reservoir for air under pressure coming from a source which is communicated therewith. The forward end of the grip portion intersects with a vertical housing portion 16. Mounted within the housing portion 16 is a cylindrical member 18 defining a cylindrical chamber within which a piston 20 is slidably sealingly mounted for movement from an upper position, as shown, through a drive stroke into a lower most position and from the lower position through a return stroke back to its upper limiting position. An annular bumper 21 of resilient material is mounted in a lower portion of the cylindrical member 18 in a position to be engaged by the piston 20 to define the end of the drive stroke thereof.

A main valve, generally indicated at 22, is provided for controlling communication of the reservoir pressure to the upper end of the cylindrical member 18 to effect the driving movement of the piston 20. The main valve 22 is pilot pressure operated and the pilot pressure chamber thereof is under the control of actuating valve structure, generally indicated at 24. Means is provided within the housing 12 to affect the return stroke of the piston 20. For example, such means may be in the form of a conventional plenum chamber return systems such as disclosed in U.S. Pat. No. 3,708,096, the disclosure of which is hereby incorporated into the present specification.

A fastener driving element 26 is suitably connected to the piston 20 and is slidably mounted within a drive track 28 formed in the nose piece assembly, generally indicated at 30, forming apart of the housing 12.

Fixed to the nose piece assembly 30 is a magazine assembly, generally indicated at 32, which is operable to receive a supply of fasteners and to feed the leading fastener of the supply into the drive track 28 to be driven therefrom by the fastener driving element 26.

The actuating valve structure 24 is provided for initiating the drive stroke of the fastener driving element 26. The actuating valve structure 24 includes a valve 34, an actuator 36 for actuating the valve 34, a trigger assembly, generally indicated at 38, for moving the actuator 36 and a work contacting assembly, generally indicated at 40, associated with the trigger assembly 38. The work engaging or contacting assembly 40 may assume a variety of different configurations. However, a preferred construction is in accordance with the teachings contained in U.S. Pat. No. 4,767,043, the disclosure of which is hereby incorporated into the present specification. Further, the valve 34, actuator 36 and trigger assembly 38 may assume any desired conventional configuration.

In accordance with the usual practice, the main valve 22 is pressurized to move from a closed position into an open position when pressure in a pilot pressure chamber thereof is relieved. The pilot pressure is relieved or dumped to atmosphere through a passage 41 upon movement of the actuator 36 from an inoperative position into an operative position. The actuator 36 is mounted for rectilinear movement in a direction towards and away from the trigger assembly 38 which is disposed therebelow.

When the actuator 36 is in its inoperative position, the supply of air under pressure within the hollow handle 14 of the housing 12 is able to pass through passage 41 which communicates with the pilot pressure chamber of the main valve 22. When the pilot pressure chamber is under pressure, the main valve 22 is in a closed position. When the pilot pressure is dumped to atmosphere upon moving the actuator 36 into its operative position via movement of the trigger assembly 38, pressure acting on the main valve 22 moves the same into its open position which communicates the air pressure supply with the piston 20 to drive the same through its drive stroke together with the fastener driving element 26.

Figure 2:
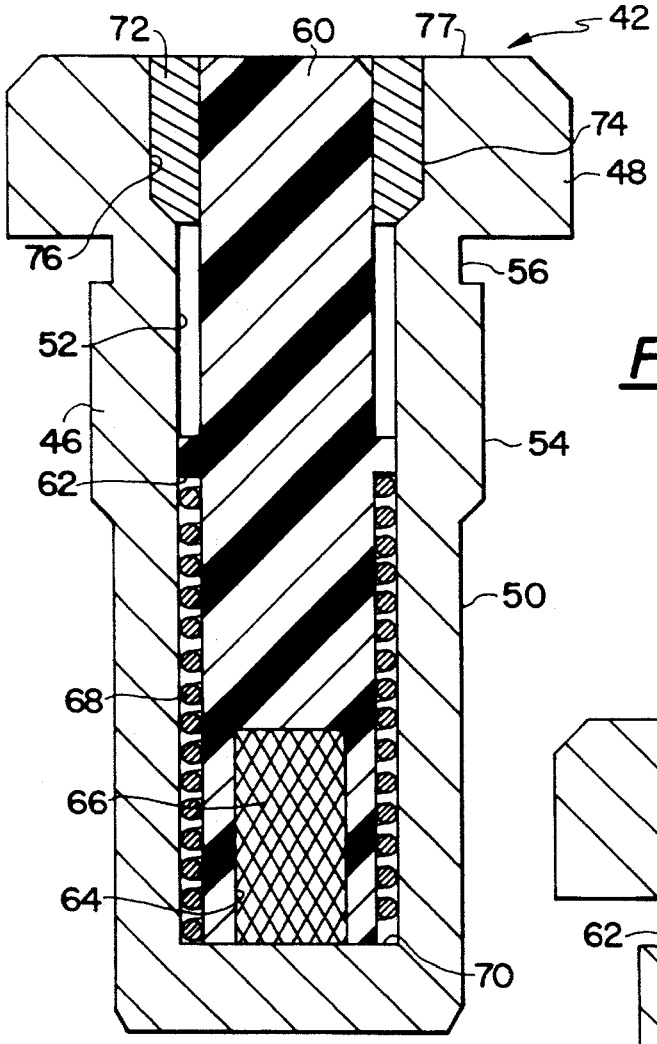
FIG. 2 is an enlarged sectional view of the overdrive signalling structure shown with a poppet thereof in a first position indicating that the tool is operating at an acceptable power level.
Figure 3:
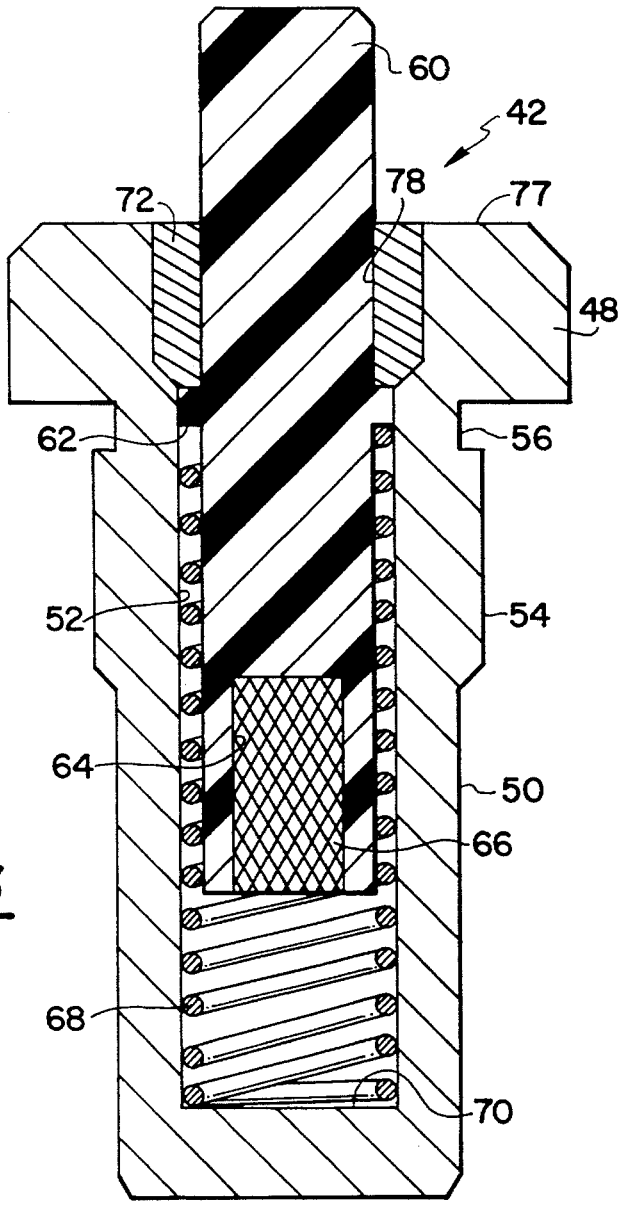
FIG. 3 is an enlarged sectional view of the overdrive signaling structure of FIG. 2 shown with the poppet disposed in a second position indicating that the tool is operating in excess required for driving a fastener.

As shown in FIG. 1, overdrive signaling structure, generally indicated at 42, is mounted within an upper portion of a cap 44 of the housing 12. As shown in FIGS. 2 and 3, the overdrive signaling structure 42 includes a metal housing 46 including a proximal head portion 48 and a shaft 50 extending from the head portion 48. The housing 46 includes a blind hole 52 therein extending into the shaft 50. A portion of the shaft 50 is threaded with external threads 54 which mate with internal threads defined in the cap 44 of the housing 12 so as to couple the overdrive signaling structure 42 to the cap 44 (FIG. 1). An O-ring groove 56 is defined in the shaft 50 of the metal housing 46 between the head portion 48 and the threaded portion of the shaft 50. An O-ring 58 is provided in the O-ring groove 56 so as to provide a seal when the overdrive signaling structure 42 is coupled to the cap 44 of housing 12.

The overdrive signaling structure 42 includes an impulse responsive member or poppet 60 which is of generally cylindrical shape having a collar 62 defined in a mid-portion thereof. The poppet 60 is preferably made of plastic or other non-magnetic material and is sized to be inserted into the blind hole 52 of the metal housing 48 so as to be movable therein. A distal end of the poppet 60 includes a blind hole 64 therein, within which a magnet 66 is fixed. In the illustrated embodiment, the magnet 66 is preferably comprised of nickel and iron, has a weight of approximately 1230 g, has a 0.25 inch diameter and is approximately 0.25 inches long. The plastic pop-et 60 has an overall length of approximately 1.36 inches. The magnet 66 is preferably press-fitted into the blind hole 64 of the poppet 60.

As shown in FIGS. 2 and 3, the overdrive signaling structure 42 further includes a coil spring 68 disposed between the collar 62 and a surface 70 defining a bottom of the blind hole 52 in housing 46. The poppet 60 is retained within the blind hole 52 of housing 48 by a retainer 72. The retainer 72 is of generally annular configuration having external threads 74 which mate with internal threads 76 formed in an upper portion of the blind hole 52 of the housing 46. The retainer 72 includes a through bore 78 sized for free movement of the poppet 60 therein. The retainer 72 may also include a slot (not shown) therein for receiving a screwdriver or the like for use in assembling the retainer 72 to the metal housing 46.

The operation of the overdrive signaling structure 42 will be appreciated with reference to the Figures. FIG. 2 is an enlarged view of the poppet 60 disposed in a first position wherein the proximal end of the poppet 60 is flush with a surface 77 of the metal housing 48. For clarity of illustration, the tool 10 is not shown in FIGS. 2 and 3. The magnet 66 cooperates with the metal housing, 46 to hold the poppet 60 in its first position. When the tool 10 is being operated at an acceptable power required to drive a fastener into the substructure and the fastener is actually being driven into the substructure, the magnetic force generated by the magnet 66 is sufficient to maintain the plastic poppet 60 in its first position. Thus, the operator is signalled that the tool 10 is operating at an acceptable power condition. However, if the fastener being driven is missing the substructure to be nailed, or the tool 10 is being operated in excess of the power requirements required to drive the fastener into the substructure, the remainder of the energy that is not absorbed by the fastener and resilient bumper 21 provides an impulse force that varies in amplitude, proportional to the amount of energy being absorbed by the tool 10. This energy is measurable by instruments such as strain gauges and accelerometers.

In accordance with the principles of the invention, the poppet 60 is constructed and arranged to be responsive to the above mentioned impulse force so as to give feedback to the tool operator that the tool is overdriving, due to overpressure or that the fastener is missing the substructure intended to be nailed. Thus, with reference to FIG. 3, when the tool is overdriving, an excessive impulse force is generated as a result of the drive stroke, which overcomes the magnetic force required to maintain the poppet in its first, lowermost position. Accordingly, when the impulse force is significant, the magnet 66 is released from the metal housing 48 and the spring 68 causes the poppet 60 to move upwardly until collar 62 engages the retainer 72. Thus, the poppet 60 is disposed in its second position, with its proximal end extending beyond the surface 77 of the housing 48 so as to signal the tool operator that the tool 10 is overdriving or that the driven fastener is missing the work piece of substructure intended to be fastened.

As shown in FIG. 1, the overdrive signalling structure is simple and practical and does not interfere with the tool's operation. FIG. 1 shows the poppet 60 in its second, extended position. The poppet 60 "pops-up" during an overdrive condition, but does not prevent the operator from continuing to drive fasteners. Once the operator is signaled by the extended poppet 60, the operator may re-align himself with the substructure so as to ensure that the fastener is engaging the substructure or the operator may need to adjust the tool pressure, which is typically between 60 and 100 psi, so as to ensure that the tool is not overdriving. Once the proper adjustment has been made, the poppet is manually pressed downwardly against the bias of the spring 68 so that the magnet 66 interacts with the metal housing 48, thereby resetting the poppet 60 into its first position. Thus, the magnet 66 and spring 68 define biasing structure, with the magnet maintaining the poppet 60 in its first position until an excessive impulse force is experience which overcomes the magnetic force, thereby permitting the spring to bias the poppet 60 to its second position.

The overdrive signaling structure 42 is particularly useful in construction, and specifically, for use in decking and sheeting over wood framing.

From the foregoing, it can be appreciated that the fastener driving device including the overdrive signaling structure provides numerous advantages by providing feedback to the user. The life of the tool can be prolonged since the tool may be operated at the correct line pressure, thereby preventing overdriving. Further, materials and time are not wasted due to repeatedly missing the substructure intended to be nailed.

It thus will be appreciated that the objects of the invention have been fully and effectively accomplished. It will be realized, however, that the foregoing preferred embodiment of the present invention has been shown and described for the purpose of illustrating the structural and functional principles of the present invention and is subject to change without departure from such principles.

What is claimed is:

1. A fastener driving tool comprising:

a portable housing defining a fastener drive track, a fastener driving element carried by the housing for movement within the drive track through successive cycles of operation, each of which includes a fastener driving stroke and a return stoke, a drive piston operatively connected with the fastener driving element for movement therewith, a magazine assembly carried by the housing for receiving a supply of fasteners and feeding successive fasteners into the drive track in a position to be driven into a work piece during successive fastener driving strokes of the fastener driving element, actuating structure carried by the housing and being constructed and arranged to move from a normal, inoperative position into an operative position to initiate the movement of the drive piston and the fastener driving element through a fastener driving stroke, overdrive signaling structure carried by the housing and including an impulse responsive member mounted with respect to the housing so as (1) to remain in a first position when the fastener driving tool is being operated at an acceptable power required to drive a fastener into the work piece and (2) to move from said first position thereof to a second position extending outwardly from the housing in response to an excessive impulse force resulting from a fastener driving stroke of the tool, thereby signaling the tool operator that the tool is being operated at a power in excess of the power requirements to drive a fastener into the work piece.

2. The fastener driving tool according to claim 1, wherein the overdrive signalling structure includes biasing structure constructed and arranged to bias said impulse responsive member so as to remain in its first position when the fastener driving tool is being operated at an acceptable power required to drive a fastener into the work piece, said biasing structure biasing said impulse responsive member to its second position in response to an excessive impulse force.

3. The fastener driving tool according to claim 2, wherein said overdrive signalling structure includes a metal housing threadedly engaged with a portion of the portable housing and including a blind hole therein, said impulse responsive member being a poppet biased by said biasing structure so as to be movable within said blind hole of the metal housing, said poppet having distal and proximal ends, said proximal end being flush with a surface of said metal housing when said poppet is in its first position, said poppet being constructed and arranged so that said proximal end thereof extends beyond said metal housing surface when said poppet is in its second position.

4. The fastener driving tool according to claim 3, wherein the biasing structure includes a magnet disposed at the distal end of said poppet and cooperating with a surface defining a bottom of said blind hole of the metal housing so as to maintain the poppet in its first position by a magnetic force, and a spring coupled to said poppet for biasing said poppet into its second position when an excessive impulse force is generated which overcomes the magnetic force.

5. The fastener driving tool according to claim 4, wherein said poppet is made from non-magnetic material.

6. The fastener driving tool according to claim 5, wherein the poppet is made from plastic material.

7. The fastener driving tool according to claim 4, wherein said overdrive signalling structure further includes a retainer for retaining said poppet within said metal housing, said poppet including a collar, said collar engaging a surface of said retainer when said poppet is biased by said spring in its second position.

* * * * *